US005460499A

United States Patent [19]

Franklin

[11] Patent Number: 5,460,499

[45] Date of Patent: Oct. 24, 1995

[54] CONCRETE BUILDING FRAME CONSTRUCTION APPARATUS

[76] Inventor: James W. Franklin, 1611 Francisca Rd. NW, Albuquerque, N.M. 87107

[21] Appl. No.: 113,399

[22] Filed: Aug. 27, 1993

[51] Int. Cl.[6] ..... E04G 11/20; E04G 11/28

[52] U.S. Cl. ..... 425/65; 249/20; 264/33

[58] Field of Search ..... 249/15, 19, 20, 249/23, 210, 211, 24; 425/63, 65; 264/33

[56] References Cited

U.S. PATENT DOCUMENTS

| | | | |
|---|---|---|---|
| 1,667,253 | 4/1928 | Hawley, Jr. | 264/33 |
| 1,701,113 | 2/1929 | Keller . | |
| 2,470,671 | 5/1949 | Withrow | 425/63 |
| 2,590,304 | 3/1952 | Flores | 25/131.5 |
| 3,194,532 | 7/1965 | Harrill | 249/19 |
| 3,215,389 | 11/1965 | Williams | 248/327 |
| 3,275,719 | 9/1966 | Dudson | 264/33 |
| 3,689,018 | 9/1972 | Pelle et al. | 249/24 |
| 3,755,983 | 9/1973 | Beckham | 52/326 |
| 4,029,286 | 6/1977 | Ahl | 249/19 |
| 4,123,031 | 10/1978 | Hyre | 249/24 |
| 4,206,162 | 6/1980 | Vanderklaauw | 264/33 |
| 4,422,617 | 12/1983 | Gallis | 249/19 |
| 4,508,308 | 4/1985 | Rossin et al. | 249/19 |
| 4,530,648 | 7/1985 | Phillips | 249/20 |
| 4,650,150 | 3/1987 | Pacheco-Pifano | 249/19 |
| 5,086,605 | 2/1992 | Tzincoca | 52/745 |

FOREIGN PATENT DOCUMENTS

| | | | |
|---|---|---|---|
| 108249 | 5/1939 | Australia . | |
| 2403434 | 5/1979 | France | 249/20 |
| 616389 | 7/1978 | U.S.S.R. . | |

OTHER PUBLICATIONS

Normile, Dennis, "Building–by–numbers in Japan", Engineering News record, Mar. 1, 1993, pp. 22–24.

*Primary Examiner*—Khanh P. Nguyen
*Attorney, Agent, or Firm*—Flehr, Hohbach, Test, Albritton & Herbert

[57] ABSTRACT

Apparatus for a "top-down" construction technique for concrete frame buildings is described. Deck formwork assemblies for each structural concrete slab diaphragm are lowered and supported from the structural slab above the same. This support is provided by suspension rods which threadably engage attachment nuts embedded in the upper structural slab.

12 Claims, 11 Drawing Sheets

CONCRETE BUILDING FRAME CONSTRUCTION APPARATUS

BACKGROUND OF THE INVENTION

The present invention relates to the construction of multi-level concrete building structures and, more particularly, to apparatus for such construction in which a deck support formwork assembly for a structural concrete slab is lowered into position and supported from the level above for the making of the next lower structural concrete slab.

The vertical frame elements of concrete building structures generally are made up of columns (which may be concrete, structural steel, or a composite of both concrete and steel) connected together via slabs of reinforced concrete. These slabs are the principle horizontal frame members for the building. It is common to incorporate rebar and/or post tensioned beams in such structural concrete slabs. These slabs act not only as integral parts of building frames of multi-level concrete buildings, but also to define floors/ceiling soffits.

The most common way of constructing level dividing slabs in concrete multi-story buildings, is to construct formwork at a desired elevation for the level, install rebar and/or post tensioning tendons, and then fill the formwork with concrete which is allowed to cure. It is typical to build the slabs sequentially in a "bottom-up" approach (one above the other). When the slab for a floor level is made, the formwork to support the next slab above is installed on top of such concrete slab. If garage levels or other floors are built below grade level, it is common to excavate to the lowest elevation of slab and then proceed with the "bottom-up" slab making approach described above.

SUMMARY OF THE INVENTION

The present invention relates to apparatus for constructing the generally horizontal structural slab diaphragms of a multi-story building from the "top-down", rather than from the bottom-up. More particularly, the apparatus includes a deck formwork assembly for supporting concrete and defining a desired configuration for the bottom of a slab of the building structure, a support for the deck formwork assembly at the level of the building structure immediately above the slab to be formed, and a suspension rod extending between the deck formwork assembly and the support at such higher level. (When reference is made herein to making a concrete structural slab or constructing the same, this terminology is meant to encompass the provision of formwork for such slab, the installation of rebar or the like in such formwork, and the pouring and curing of concrete for the same, but not necessarily the many other steps that have to be accomplished before one can say that the construction procedure with respect to a particular slab is completely finished.)

It will be appreciated that the structure of the invention facilitates construction of buildings from the top-down. That is, the support and roll threaded rod elements of the apparatus enable the deck formwork assembly to be lowered from one level to the next lower level for the making of the next lower structural concrete slab.

Most desirably, the apparatus of the invention is constructed to support the deck form assembly during the making of such next lower slab, from the level defined by the first slab. The support preferably is from the structural slab which defines the higher level. Attachment nuts are provided in the first structural slab to transmit loads to such upper slab.

A major advantage of the "top-down" approach to the construction of a concrete building is the speed and simplicity of the actual construction. Upper floors, once the structural slabs for the same have been made, can be finished (partitions, windows/curtain walls can be installed, etc.) while the construction of lower slabs is taking place. And, indeed, it is not necessary for the concrete frame construction workmen to have access to such upper floors after the forms are lowered. Other advantages are that buildings can be built to zero lot line without having to fly forms over adjacent buildings. The system is extremely cost efficient because it requires so few workers and because of the speed of erection. Full 8'0" floor-to-ceiling heights can be achieved with 8'6" (or less) floor-to-floor heights.

It should be noted that the broad concept of constructing horizontal slabs in a "top-down" manner has been used in the past in other types of construction which cannot be used in constructing buildings of significant height. Reference is made, for example, to U.S. Pat. Nos. 3,194,532; 3,275,719; and 4,029,286. In such arrangements the slab is not a ductile diaphragm. The criteria for these other types of construction are completely different, and it is not obvious how those top down approaches will work in an arrangement in which the slab is a structural ductile diaphragm part of the frame in addition to dividing levels. Moreover, the apparatus is different and is incapable of use for top-down concrete building construction.

The invention also includes a wheel for rotating the roll threaded rod. Such wheel has a center portion which is adapted to engage the roll threaded rod in a generally non-rotating manner, which center portion is circumscribed by a gripping wheel. A plurality of spokes connect the gripping wheel to the center portion to transmit turning motion of the gripping wheel to the center portion and, thus, turn any roll threaded rod with which it is engaged. It further includes apparatus for removing an attachment, e.g., a nut, embedded in a slab. Such removal apparatus includes a rod for engaging the attachment in a non-slip manner and a bearing plate which is engageable both with the slab and the attachment. The length of the rod extending between the bearing plate and the attachment is reducible whereby a pulling force is applied to the attachment when an effort is made to reduce such length while the bearing plate is engaged with the slab. The apparatus further includes an attachment itself. Such attachment includes means for securing the same to a roll threaded rod and means for supporting such apparatus at the level from which the formwork assembly is to be attached.

Other features, details and advantages of the invention either will become apparent or will be described in connection with the following, more detailed description of preferred embodiments of the invention.

BRIEF DESCRIPTION OF THE DRAWING

With reference to the accompanying drawing.

DETAILED DESCRIPTION OF THE PREFERRED EMBODIMENT(S)

The following relatively detailed description is provided to satisfy the patent statutes. However, it will be appreciated by those skilled in the art that various changes and modifications can be made without departing from the invention. The following description is exemplary, rather than exhaustive.

Figure 3:
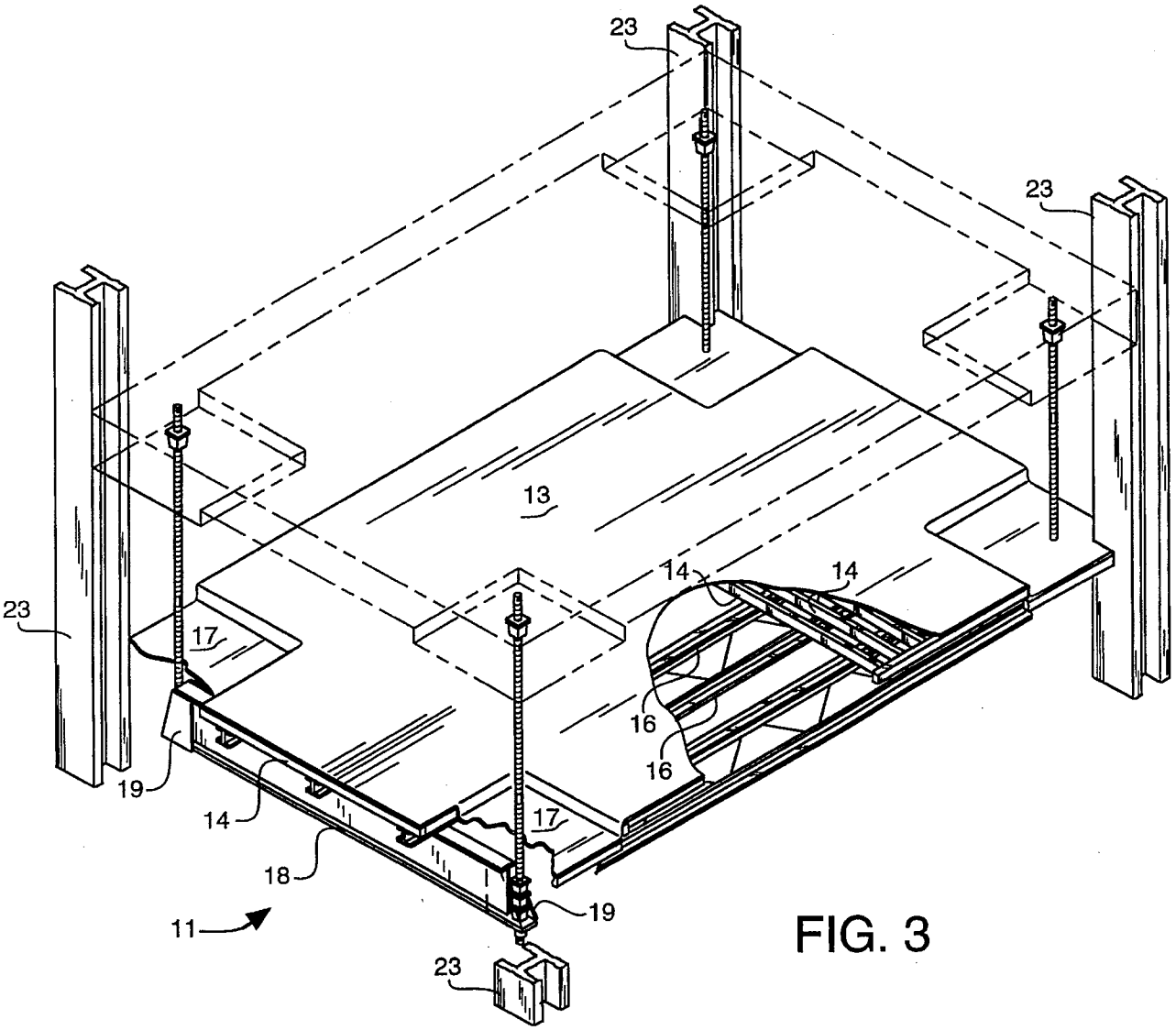
FIG. 3 is a broken away, somewhat schematic isometric view of the preferred embodiment of FIG. 1, with a showing in phantom of a concrete slab at one level above, made with a formwork assembly as illustrated.

FIG. 1 illustrates not only the major aspects of a preferred embodiment of the apparatus of the invention, generally referred to in both FIG. 1 and FIG. 3 by the reference numeral 11, but also the method of use of the same. Although specifics of the invention are described in detail with respect to the construction of structural slabs below grade level, it will be obvious to one of ordinary skill in the field that the invention is also applicable to above grade construction and which of these specifics are applicable to the construction of structural slabs above grade level.

The apparatus illustrated in FIG. 1 includes a deck formwork assembly 12 for supporting concrete for a structural slab. Such assembly includes an upper platform 13 against which concrete for a structural slab to be made is poured. As best illustrated in FIG. 3, such platform includes a raised central portion which defines a structural slab soffit, which portion is defined by a membrane formed, for example, from plywood supported by a frame made up primarily of 2×6 joists 14 which, in turn, are supported by steel bar joists 16. Dropheads 17 are formed at each column. The support portion of the assembly 12 also includes a pair of end I-beams 18 which support the remainder of such assembly. Each I-beam 18 (only one of which can be seen in FIG. 2) terminates in a protective pocket 19, the purpose of which will be described in more detail hereinafter.

Figure 1A:
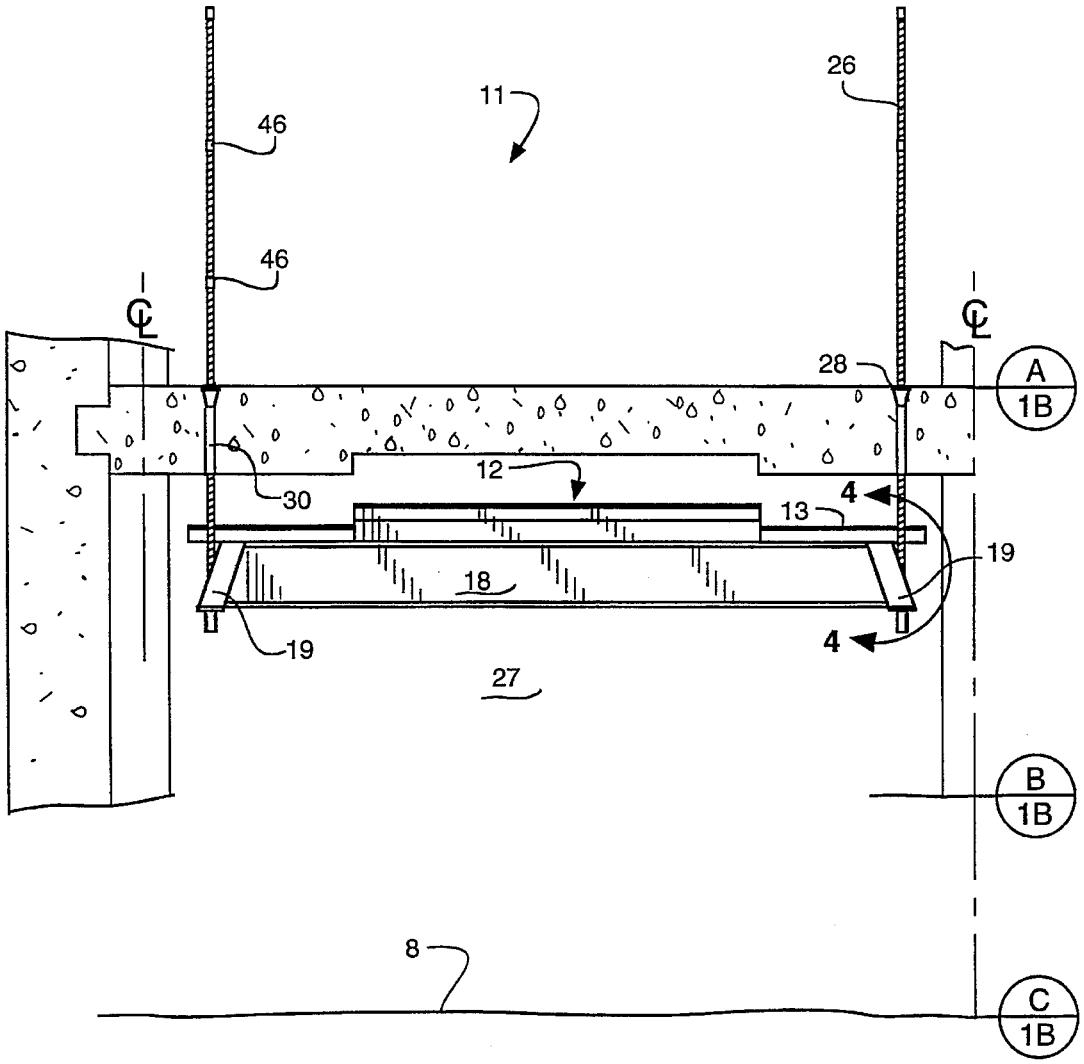
FIGS. 1A, 1B, 1C and 1D provide an overall elevation view schematically illustrating a preferred embodiment of the invention used for making structural slabs below grade level.
Figure 1B:
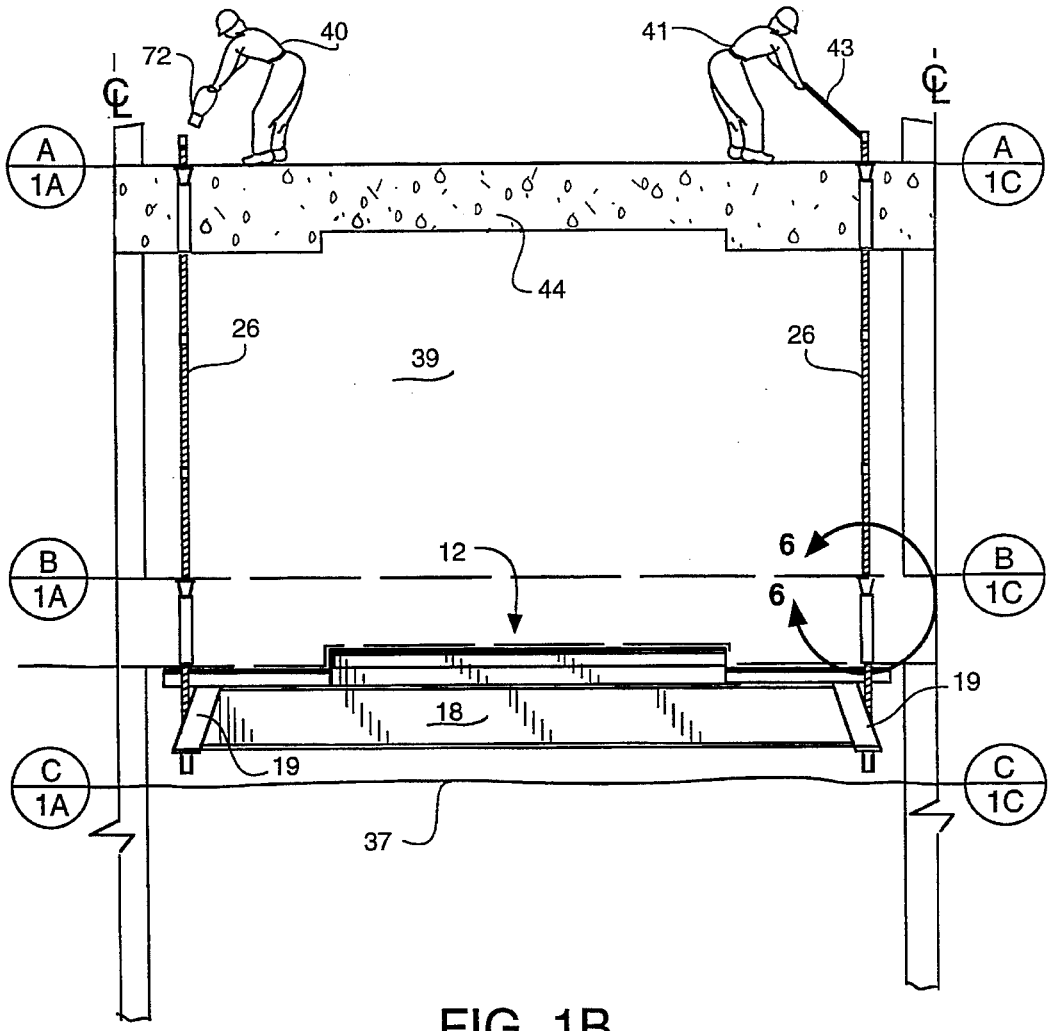
Figure 1C:
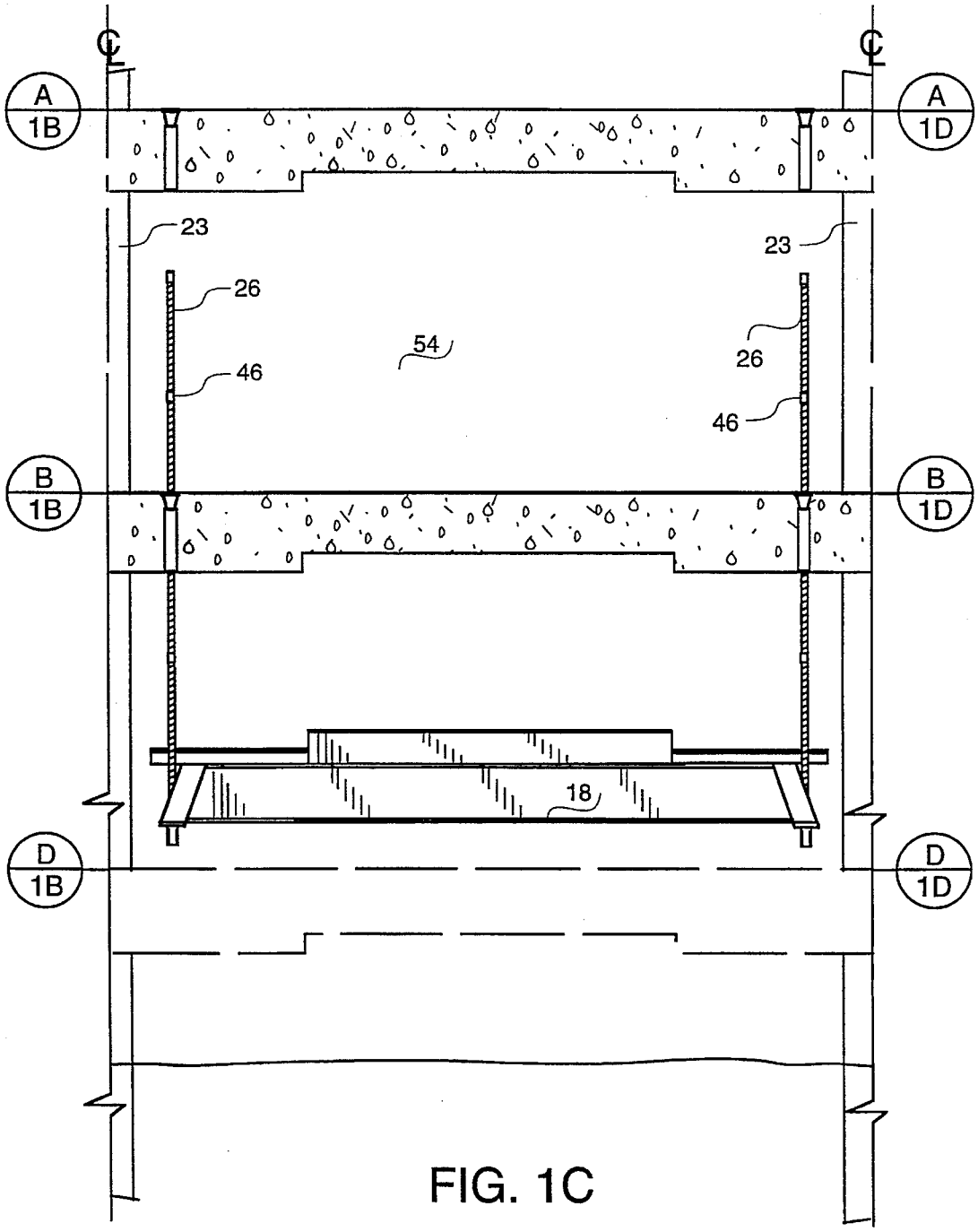
Figure 1D:
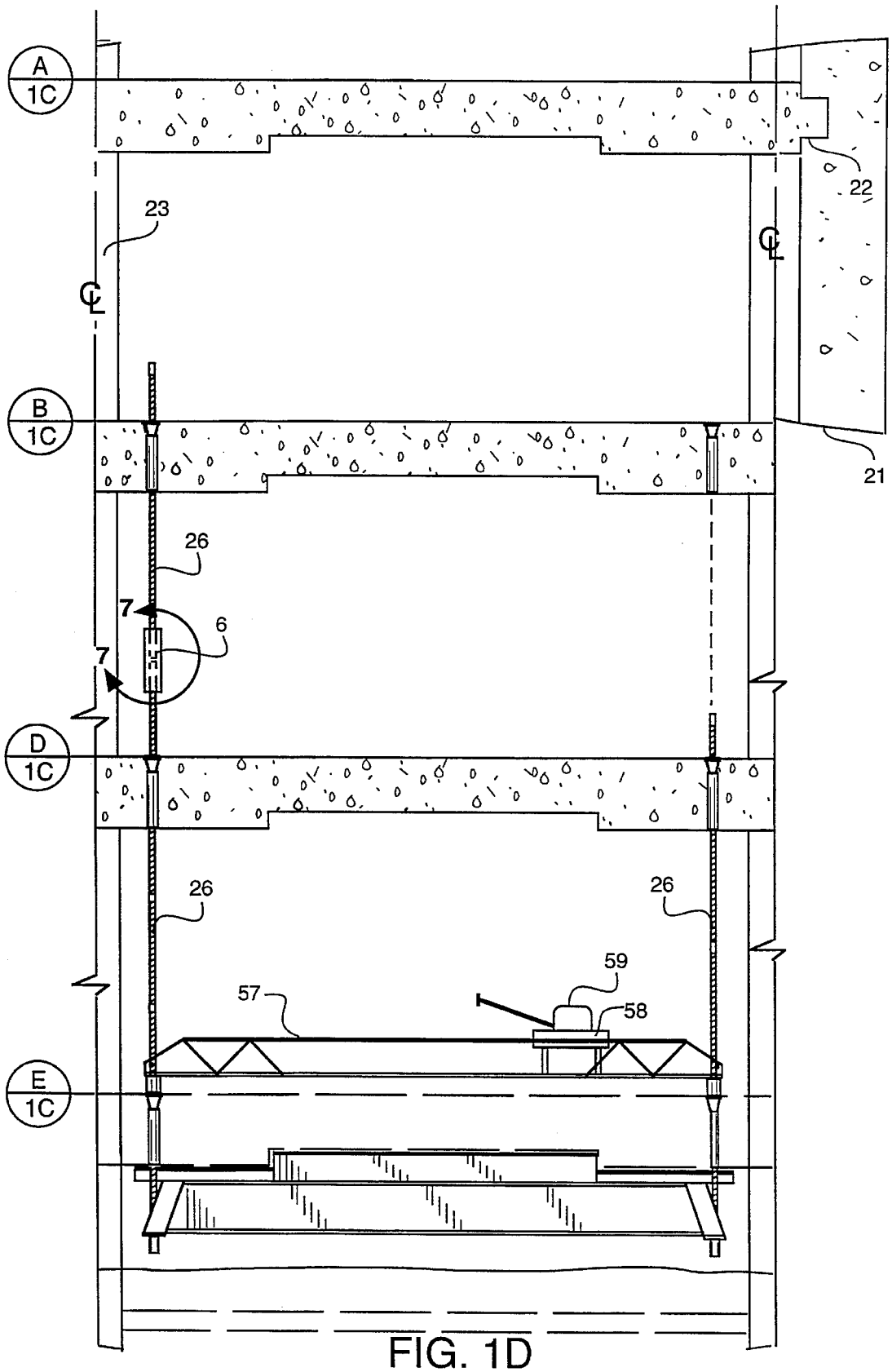
Figure 2:
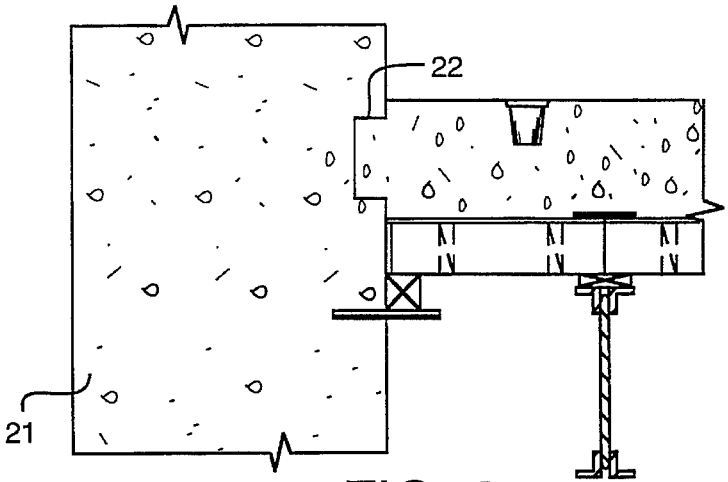
FIG. 2 is a partial sectional view illustrating more specifically a preferred arrangement of interfacing a formwork assembly of the invention with a slurry wall.

When the invention is used for making slabs below grade, i.e., below the level of the ground, at a location in which significant egress of water is to be expected, e.g., a coast site, a water barrier wall 21 is formed surrounding the site at which such slabs are to be made. Such barrier wall 21 is simply a slurry wall, and in an implementation of the invention for the construction of a multi-level underground garage, the wall 21 was a 3-foot thick slurry wall that was 100-feet deep. As illustrated in FIGS. 1 and 2, the decks are dowelled and poured into the slurry wall via a keyway 22.

A generally vertical structural frame network of columns for interaction with the structural slabs is provided. Such network includes vertical columns 23 which extend upward from a stable base. In one realization of the invention, the steel columns were secured to bedrock by the formation of a grid of 5 to 8 foot diameter concrete caissons which served as foundations for the columns. Cages of reinforcing steel were provided in the holes augured for the columns 23. Then tremied concrete was inserted in the holes to displace a polymer driller's mud that had been used within the holes to prevent the sides of the same from caving in. Enough concrete was poured in the holes to cover the steel columns from bedrock to the elevation of the bottom slabs to be formed.

As mentioned earlier, the invention particularly relates to concrete construction in which the slabs act not only to define the floors/ceiling soffits of the various levels, but also act as primary horizontal structural diaphragms. A significant aspect of the invention is its use in the making of such horizontal structural slabs in a top-down arrangement with the repetitive use of the same deck formwork assembly. This is unusual in that the building will not have a permanent structural frame at the location at which slabs are made (or at any level below the same). It only does so after a slab is poured and cured at such location. In the traditional "bottom-up" approach this is no problem since the structural frame of a building is completed all the way from the foundation to the top as the slabs are made. In contrast, when the horizontal structural slabs are made in a top-down arrangement the completed portion of the frame for the building is the upper part, i.e., that part in which the slabs have already been made. It will be appreciated, though, that the construction of the horizontal slabs at the upper part of the building provides meaningful structural stiffening to the vertical frame columns. In this connection, it should be noted that each completed slab acts as a structural diaphragm that ties the columns together in a rigid framework while the soil beneath the slab is excavated for the construction of the next lower level.

The invention enables a deck formwork assembly for one level to be lowered to the next lower level to be made, and as each level is constructed the support for the formwork assembly is provided at the level that has just been defined. Most desirably, the support is provided by the slab itself by an attachment of the invention embedded within the same to transmit the loads encountered during construction of the next lower slab, to such upper slab. This procedure is best illustrated in FIGS. 1A–1D which show the bays of adjacent slabs being made. (It will be appreciated that such figures are not true-to-life in that a single slab pour will include several bays in one level.) Each deck form assembly 13 is suspended from the level above via threaded suspension rods 26 at each corner.

The level above a level to be made provides support for the deck form assembly. With reference, for example, to bay 27 of FIG. 1A in this embodiment, such support takes the form of a shoulder nut 28 which is embedded in the concrete slab for the bay. In this connection, each of the threaded rods 26 mates with the interior threads of the corresponding nut 28. Each rod also has a plastic sleeve 30 extending from the nut through the slab to protect the rod from concrete when it is poured and to define the axial hole through the slab necessary for the rod.

Figure 4:
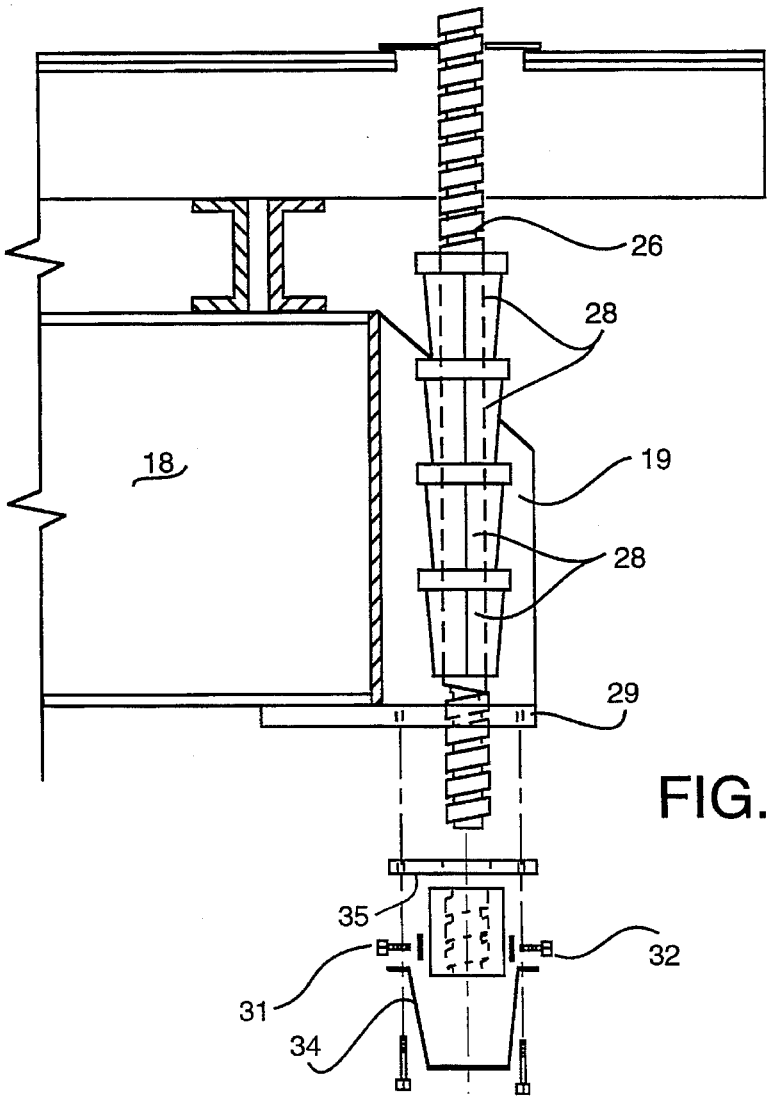
FIG. 4 is an enlarged and partly exploded sectional view, generally showing the area encircled by the line 4—4 in FIG. 1A.

Each of the threaded rods 26 terminates and is threadably connected to the deck formwork assembly in an associated pocket 19. FIG. 4 is an enlarged sectional view which illustrates the same in more detail. That is, each threaded rod extends through a flange 29 at the bottom of the pocket and then terminates in an anchor or end nut 31. Such nut is made non-rotatable with respect to the threaded rod end via, for example, the use of locking bolts 32. Thrust straps 34 also can be provided to transmit the thrust applied to the rod 26 to the flange 29 and, hence, to the main end beam 18 of the form assembly. A washer 35 is provided which is heavily greased to permit rotation of the roll threaded rod 26 and, hence, nut 32, with respect to flange 29. A plurality of shoulder nuts 28 to be embedded in the concrete slabs defining other levels are also provided on the rod as illustrated.

Figure 5A:
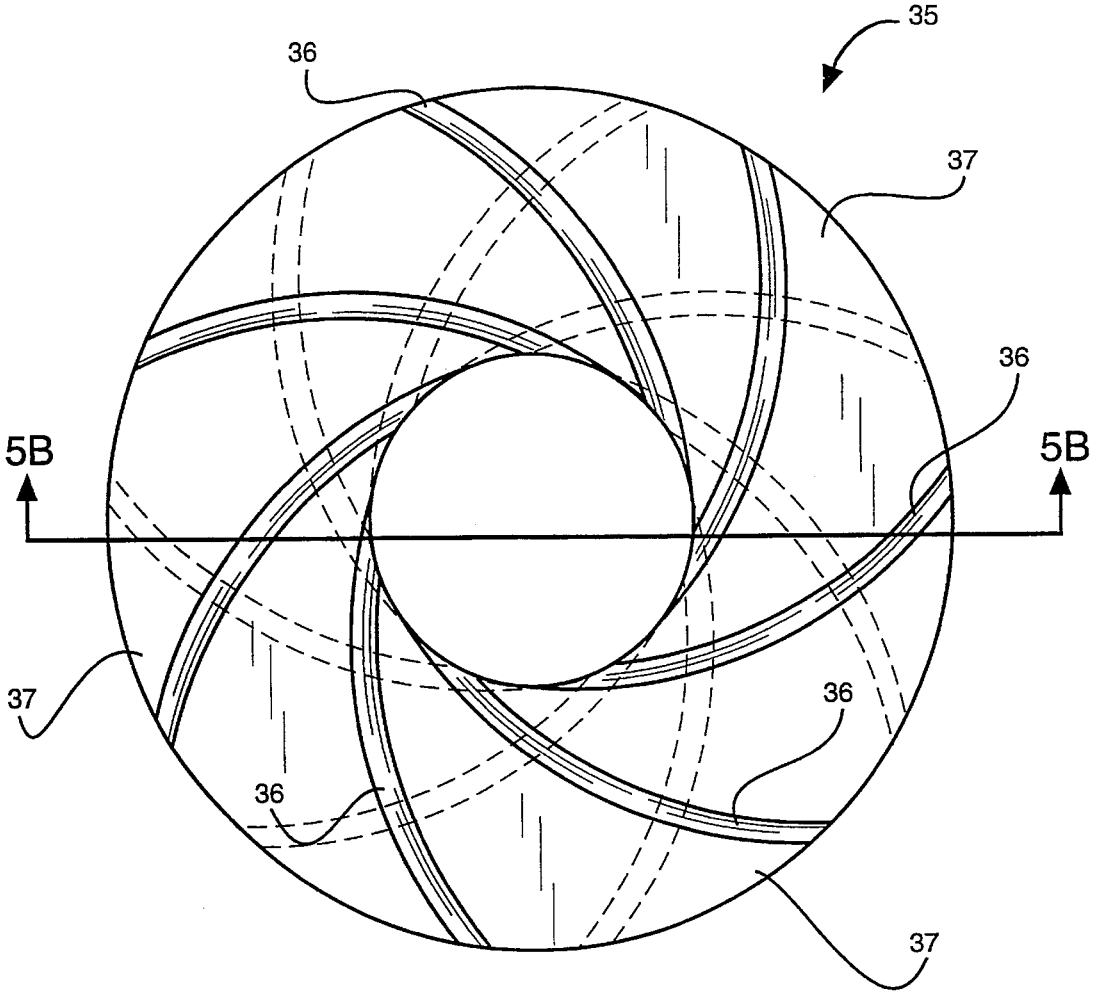
FIGS. 5A and 5B are enlarged plan and end sectional views, respectively, of a washer especially designed for the invention.
Figure 5B:
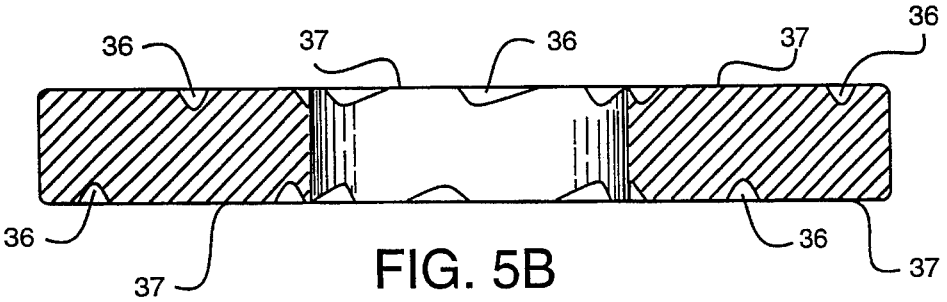
Figure 6:
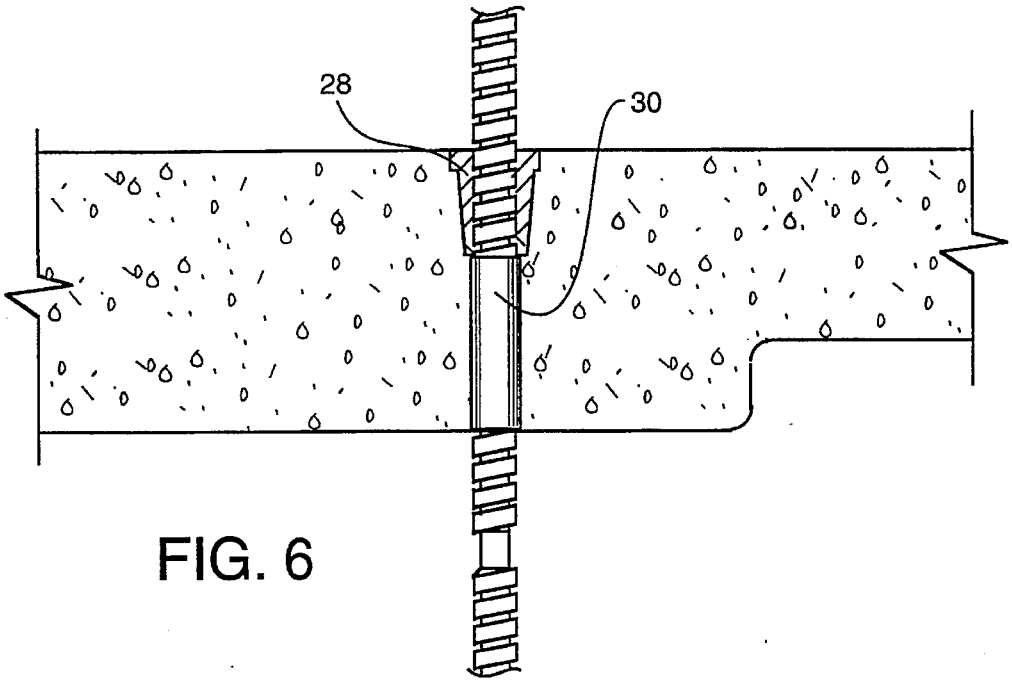
FIG. 6 is an enlarged sectional view generally showing the area encircled by the line 6—6 in FIG. 1B, after concrete is poured and set.

It will be recognized that there often is a significant load on the threaded rods, and in many situations it is desirable to facilitate the turning of the same. Washer 35 is especially designed to cooperate with grease to permit such rotation. FIGS. 5A and 5B are enlarged views of such washer, showing that it has radial grooves 36 on opposite sides of a center plate 37. Each groove on one side defines a channel for the distribution of grease from the rod to the side of the washer associated with such groove. As illustrated, the grooves 36 on one side have a circumferential component in one direction, whereas the grooves on the opposite side of the plate have a circumferential component in the opposite direction. Because of these opposite circumferential directional components, grease will be distributed in both directions of rotation of the threaded rod.

In the below-grade arrangement being described, before the deck formwork assemblies for a slab are lowered, the volume of material (earth) for the next lower level is excavated. The excavation is to the level, for example, indicated at 33 for bays 27 and 39. The volume excavated includes the additional depth beneath the slab to be formed at that level necessary to accommodate the depth of the deck formwork assemblies. The deck formwork assemblies are then lowered.

A deck formwork assembly can be stripped from the cured concrete slab by various means which will provide the turning torque necessary to rotate the rod to initiate lowering. Two such means are schematically depicted for the bay 39, by the workers 40 and 41 schematically shown respectively applying an impact wrench 42 and a spud wrench with a cheater 43 to the end of two of the rods 26.

Figure 7A:
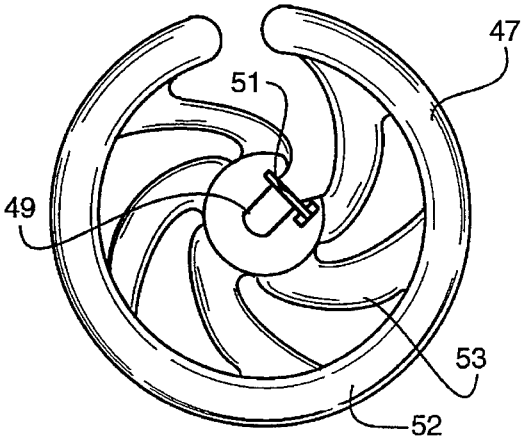
FIG. 7A is a plan view of a preferred embodiment of a wheel of the invention used to turn a rod to be described and lower the form assembly.
Figure 7B:
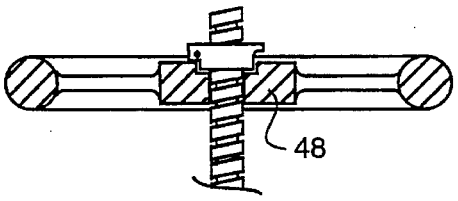
FIG. 7B is a sectional view of the wheel of FIG. 7A showing the same in engagement with a rod.

Once the deck formwork assemblies for a concrete slab are stripped from the concrete soffit at one level, they can be lowered into position to form the next lower slab. That is, the length of the threaded rod extending between the form assembly and the nut is increased. Each of the threaded rods 26 is provided with spaced machined areas or notches represented in FIG. 1 at 46, for engagement to adjust the elevation of the deck form at the threaded rods. The spacing of the machined notches or portions on the threaded rods 46 should be such that one is assured to have a machined notch in easy range for use by a worker. FIGS. 7A and 7B illustrate a turning wheel 47 which is particularly designed to engage such a machined notch 46 and rotate the associated threaded rod. The wheel 47 includes a center portion 48 adapted to engage a machined notch 46. Such center portion includes a slot 49 which is closable by a rotating latch 51. A weighted gripping wheel 52 circumscribes the center portion and is connected to the same by a plurality of spokes 53. It will be appreciated that turning of the weighted wheel will transmit turning motion of the same to the center portion and, hence, to any threaded rod engaged by the same.

As a slab is made defining a level, the deck form can be lowered (after excavation) for reuse at the next lower level. The step of making a structural slab with the invention is repeated for each slab. This repetition is represented by bays 54 and 56.

The invention is also applicable to the use of a concrete vibrating screed. As is illustrated in bay 56, a screed rail 57 can be provided connecting two adjacent threaded rods 26 as illustrated. It will be appreciated, although not shown, that a similar screed rail connects the other two threaded rods of each form assembly. A carrier 58 for a vibrating screed 59 can travel along the length of the rails to position the screed at an appropriate location and elevation therefor.

The shoulder nut attachment/threaded rod arrangement is used in the preferred arrangement being described, not only to lower and support the deck formwork assembly itself, but also to provide the support necessary to transmit the load of the poured and curing concrete slab to the concrete slab above the same. That is, as is best illustrated by the bay 38, the threaded rods 26 extend upward to the concrete slab represented at 44 and support not only the formwork assembly 12, but the poured concrete for the next lower slab.

Figure 8:
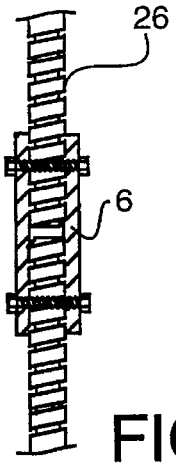
FIG. 8 is an enlarged sectional view of a coupler for a pair of axially aligned rods.

In some instances it is desirable to transmit the loads encountered by a deck formwork assembly and the concrete supported by the same, to more than one higher completed slab. FIG. 8 illustrates a coupler 61 joining axially aligned threaded rods 26 for this purpose. It will be noted from FIG. 1 that the upper threaded rod is connected to the shoulder nut 28 at the upper structural slab, whereas the lower threaded rod is suitably received within the shoulder nut in the lower slab. With this arrangement, the loads on each deck formwork assembly will be transmitted to the two adjacent upper slabs as long as the threaded connections all are tight.

Figure 9:
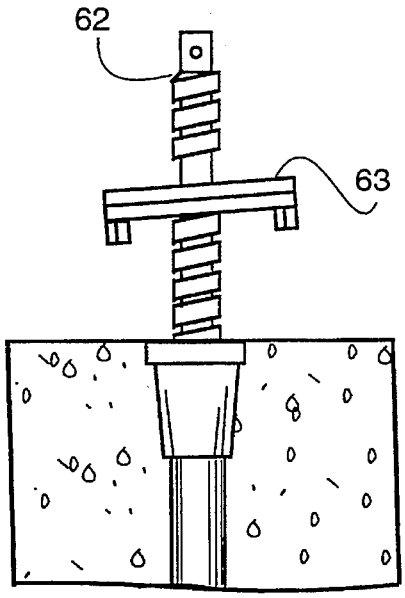
FIG. 9 is a nut pulling apparatus of the invention.

After the shoulder nuts in a completed slab are no longer being used, they can be pulled from the slab. FIG. 9 illustrates a nut pulling arrangement. Such arrangement includes a rod 62 which is, in essence, a much shorter version of a threaded rod. The rod 62 has a center section which is machined to a smaller diameter to thereby create a shoulder. Such rod engages the nut in a non-slip manner by being threaded into the same.

The pulling apparatus also includes a bearing plate 63 which bears upon the slab from which the nut is to be removed and is a stop for the upper edge of the notch on the rod. It will be appreciated that turning of the rod in the appropriate direction will result in the length of the same extending between the bearing plate and the nut being reduced, so that a pulling force is supplied to the nut whenever an effort is made to reduce such length while the bearing plate is on the slab. Once the nuts have been removed, the columns at a particular level defined by a suspended slab can be encased as is common.

Figure 10A:
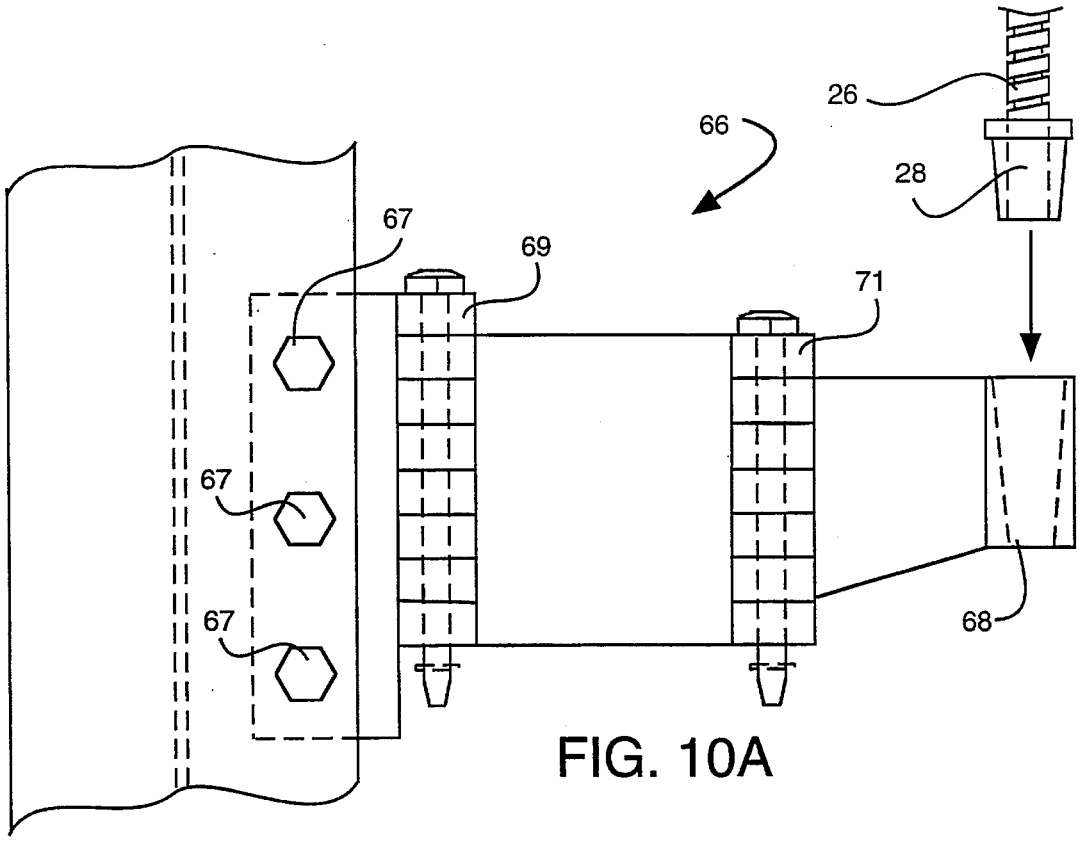
FIG. 10A is an elevation view of an alternate hanger arrangement.
Figure 10B:
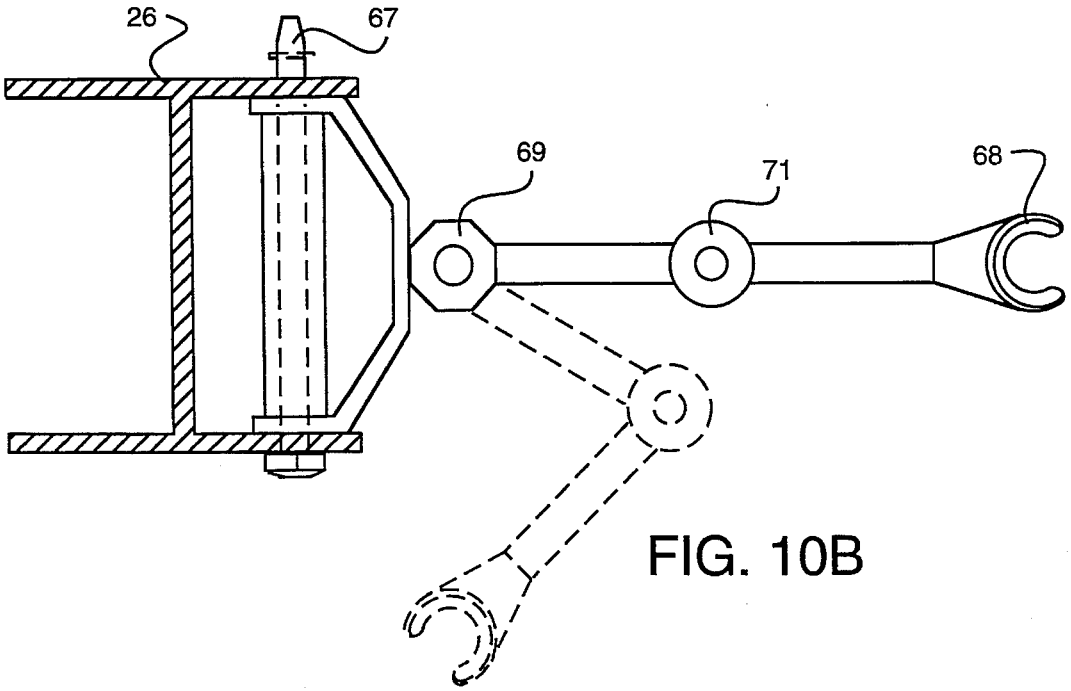
FIG. 10B is a plan view of the alternate hanger arrangement of FIG. 10A.

It will be recognized that in some situations it is desirable to make use of the lowering enabled by the invention even though it is not desired to apply the load of the concrete to be poured to the slab at the higher level. In many instances the slabs will not be designed to provide such load support and will be incapable, for example, by being too thin, of providing the desired support. Moreover, in some of such situations, it either is impractical or undesirable to use couplers as discussed above to transmit the load to more than one slab. FIGS. 10A and 10B show an alternate arrangement for supporting the threaded rods without use of already formed (constructed) slabs. That is, an articulated support arm, generally referred to by the reference numeral 66, is connected via pins 67 to one of the columns, represented at 23. The arm 66 terminates in a cup 68 configured to interact with a nut 28 for a roll threaded rod 26. It will be appreciated that for each deck formwork assembly to be supported, there will be four of these support arms 66, one at each of the corners of the deck formwork assembly. The arm 66 is adapted to be infinitely adjustable relative to the positioning of the cup 68. To this end, it includes a pair of hinged joints 69 and 71 which facilitate positioning adjustment. The freedom provided by the adjustment ability of the cup portion enables use of the arms at many locations where other attachment apparatus might be difficult to use.

It is desirable that the articulating support arms be at a level just above the location desired for the new structural slab. Holes at the four corners of the finished slab allow the threaded rods to pass therethrough. It will be appreciated that the lowering of the form, etc. is essentially the same as that described when the nut 28 is embedded within, or placed on top of, the upper structural slab itself.

Figure 11:
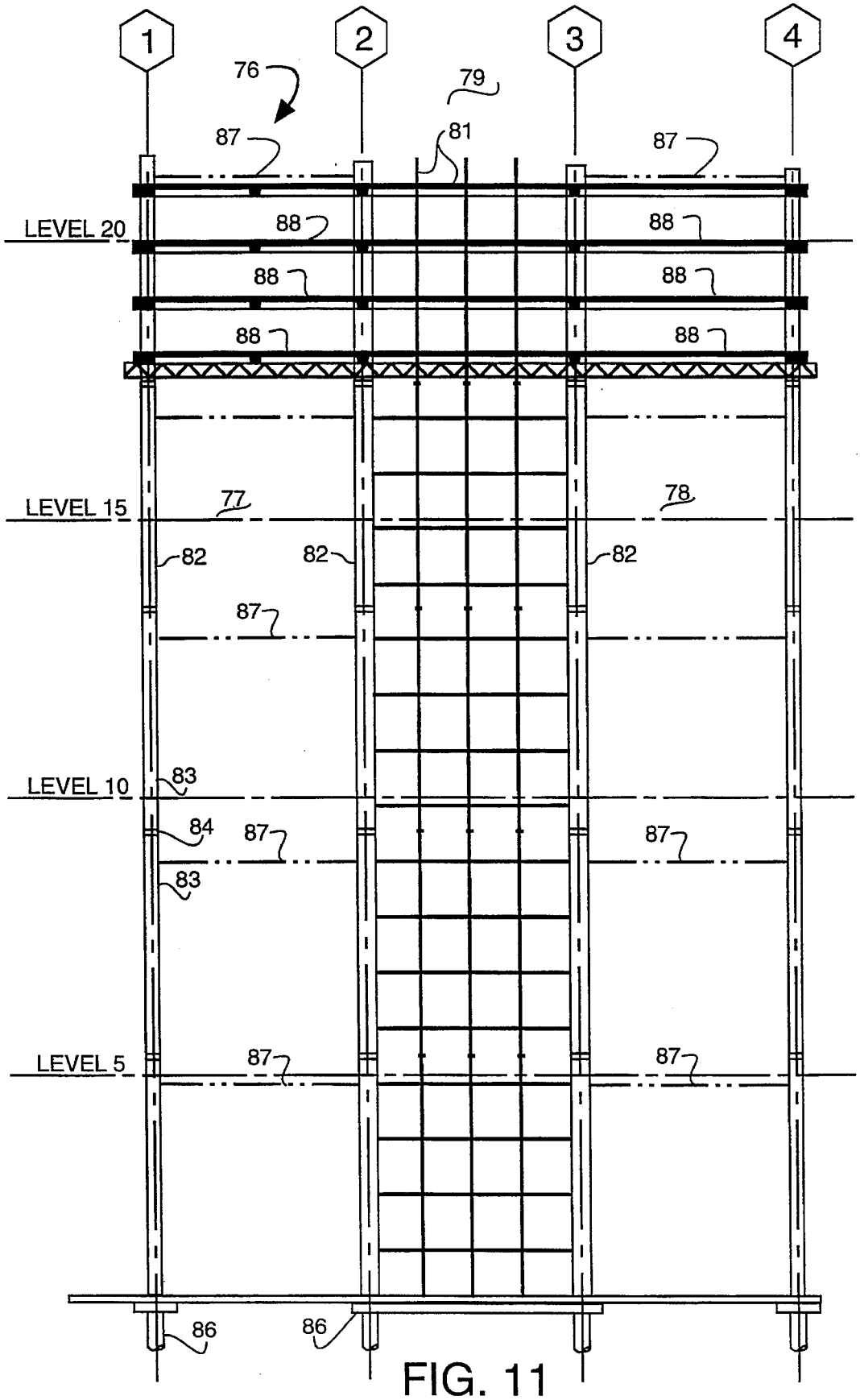
FIG. 11 is an elevation view illustrating a preferred embodiment of the invention in which slabs are made above grade level for a multi-level concrete building structure.

As mentioned previously, the apparatus of the invention is particularly applicable to the formation of above-grade levels for concrete multi-story buildings. FIG. 11 is a plan view schematically illustrating such an arrangement, generally referred to by the reference numeral 76. The specific design has twenty above-grade levels (19 floor/soffit slabs and one roof slab). The construction includes bays, two of which are shown at 77 and 78 surrounding a core bay 79. The core bay is designed for stairwells, elevators, etc. and includes lightweight bracing represented at 81 to support those core elements which are installed before the structural slabs are formed with the invention. The building structural frame includes a plurality of vertical columns 82 akin to the columns 23 of the below grade construction described previously. Each of the columns 82 is made up of column sections 83 which are joined as illustrated at 84 in the field in accordance with conventional techniques. Each of such columns can be concrete, structural steel, or a composite of both, for example, concrete encased in a metal tubular shell. Such columns are supported via footings 86 or the like in accordance with conventional techniques depending upon local conditions. Temporary bracing represented by lines 87 is also provided to aid in supporting the columns 82 until the horizontal structural frame slabs are formed in accordance with the invention. In this connection, such horizontal structural frame slabs are represented at 88. The manner in which they are provided above ground is essentially the same as that described previously in connection with the formation of below grade slabs. Such slabs may have any desired configuration, e.g., have a beam-in slab configuration. The top roof slab is formed by hanging the rods from temporary bracing supporting the columns.

Each structural slab will incorporate the lightweight bracing for the columns in the core bay. Moreover, the temporary bracing in the other bays at each particular level will be removed just before the form assemblies are lowered to the particular level having such bracing. In the schematic arrangement illustrated, four slabs have been made.

Figure 12:
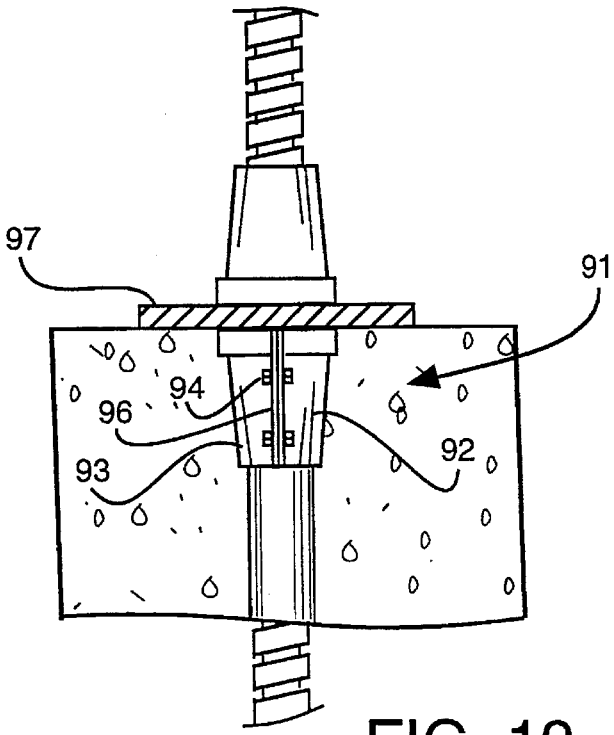
FIG. 12 is an enlarged sectional view similar to that of FIG. 5, showing an alternate arrangement for supporting a threaded rod.

In some situations, the number of levels to be formed makes it impractical to provide enough shoulder nuts 28 in a protective pocket 19 for all the levels to be made. This is particularly true in multi-story, above grade construction projects. In such a situation it is desirable to be able to provide a split shoulder nut which can be installed on a threaded rod after the threaded rod is in position, thus eliminating the need to have it already installed on the rod. FIG. 12 is a sectional view showing such an arrangement. The nut 91 is made up of two halves, 92 and 93, bolted together via bolts 94 extending through mating flanges 96. Although not shown, it will be recognized that there are similar mating flanges 96 and bolts 94 diametrically opposite those illustrated.

It is also desirable in some situations that a shoulder nut be utilized that is not embedded in the concrete. As illustrated in FIG. 12, a shoulder nut 28 is threaded upside down on the threaded rod and bears tightly against a bearing plate 97. If desired, such shoulder nut can include an extension (not shown) for facilitating gripping of the sleeve 30 so that removal of the shoulder nut will result also in the removal of such sleeve. It will be seen that the load carried by the threaded rod is transferred through the upside down nut and bearing plate 97 to the structural slab.

The "top-down" construction of the floor/ceiling structural slabs of the building frame provided by the invention greatly simplifies the construction procedure. It also enables the concrete structure to be completed in a much shorter time. It will be seen that after the next lower slab is made, it is not necessary for the workmen involved in the frame/slab construction to have access to the other, higher levels. Thus, the invention makes it appropriate for a contractor constructing such a building to provide complete access for sub-contractors to each of the floors following, in essence, the construction of the structural slab. That is, as soon as a slab is completed the interior walls, curtain walls, the interior finishing, etc. can be completed. Thus, when the instant invention is utilized, a building can be completely finished in little more time than is required to construct the frame for the same. Even making the frame is simplified in view of the ability to support the horizontal slabs for one level from the next higher level.

As mentioned at the beginning of the detailed description, Applicant is not limited to the specific embodiments described above. Various changes and modifications can be made. As mentioned previously, the specific embodiments are exemplary, rather than exhaustive. The claims, their equivalents and their equivalent language define the scope of protection.

What is claimed is:

1. Apparatus for forming a plurality of generally horizontal structural slab diaphragms for levels of a multi-level building structure, comprising:

(a) a deck formwork assembly for supporting concrete and defining a desired configuration for the bottom of a structural slab of said building structure;

(b) a support for said deck formwork assembly at the level of said building structure immediately above the structural slab to be formed with said deck formwork assembly;

(c) a suspension rod extending between said deck formwork assembly and said support at said level immediately above the slab to be formed; and (d) said support being an attachment for said rod embedded in the concrete of the structural slab immediately above the structural slab to be formed.

2. The apparatus of claim 1 further including means for removing said attachment from said slab structural.

3. The apparatus of claim 1 wherein the length of suspension rod extending between said formwork assembly and said support at said level immediately above the slab to be formed is selectively changeable.

4. The apparatus of claim 3 wherein said support is threaded interiorly thereof and said suspension rod is provided with threads which mate with and engage the interior threads of said support whereby rotation of said rod relative to said attachment results in the length change.

5. The apparatus of claim 4 wherein said suspension rod has means defining an engagement surface which is rotatable relative to said deck formwork assembly for said rod length change, and a washer is disposed between said engagement surface and said deck formwork assembly, which washer has a generally flat disk which engages said surface during said relative rotation, and channels are provided extending radially of said disk face for distributing lubricant along said face during such relative rotation.

6. The apparatus of claim 4 further including a plurality of portions of said rod along the length of said rod adapted for selective engagement of said rod to provide said rotation.

7. The apparatus of claim 1 wherein said support is threaded interiorly thereof and said suspension rod is provided with threads which mate with and engage the interior threads of said attachment whereby rotation of said rod relative to said attachment results in changing the length thereof extending between said formwork assembly and said attachment.

8. The apparatus of claim 7 wherein said rod is rotatable relative to said support to change the length of said rod extending between said formwork assembly and said support, further including a plurality of portions of said rod along the length of said rod adapted for engaging said rod to provide said rotation.

9. The apparatus of claim 1 further including a coupling for connecting said suspension rod to a similar rod extending from the level above said level immediately above the slab to be formed.

10. The apparatus of claim 1 wherein said rod is exteriorly threaded and further including a wheel which engages said rod for rotating said rod relative to said support to change the length of said rod extending between said formwork assembly and said support.

11. Apparatus for forming a plurality of generally horizontally suspended structural slab diaphragms for levels of a multi-level building structure comprising:

(a) a deck formwork assembly for supporting concrete and defining a desired configuration thereof for the bottom of a structural slab of said building structure;

(b) a support for said deck formwork assembly, positioned at the level of said building structure immediately above the slab to be formed with said deck formwork assembly;

(c) a suspension rod extending between said deck formwork assembly and said support at said level immediately above said slab;

(d) said support being an attachment for said rod embedded in the concrete of the slab defining the floor at said level immediately above the slab to be formed; and (e) said attachment being threaded interiorly thereof and said rod being provided with threads on the exterior thereof which mate with and engage the interior threads of said attachment whereby rotation of said suspension rod relative to said attachment results in a change of the length of rod extending between said deck formwork assembly and said attachment.

12. The apparatus of claim 11 further including a plurality of portions of said rod along the length of said rod adapted to be engaged to provide said rotation of said rod, and a wheel which engages said rod at said portions for said rotation.

* * * * *